US005676565A

United States Patent [19]

Vagnoni

[11] Patent Number: 5,676,565

[45] Date of Patent: Oct. 14, 1997

[54] CONNECTOR COMPATIBLE WITH AUDIO TRANSMISSION LINES, BALANCED AND UNBALANCED

[75] Inventor: Emidio Vagnoni, Morrovalle, Italy

[73] Assignee: Elettromedia Di Riccobelli Maurizio & Co.-S.A.S., Italy

[21] Appl. No.: 446,325

[22] Filed: May 22, 1995

[30] Foreign Application Priority Data

Jun. 3, 1994 [IT] Italy ..... AN94A0031

[51] Int. Cl.[6] ..... H01R 17/18

[52] U.S. Cl. ..... 439/580

[58] Field of Search ..... 439/580

[56] References Cited

U.S. PATENT DOCUMENTS 3,613,050 10/1971 Andrews ..... 439/580
4,553,806 11/1985 Forney, Jr. et al. ..... 439/580
4,708,666 11/1987 Fisher, Jr. ..... 439/580
4,759,729 7/1988 Kemppainen et al. ..... 439/580
4,799,902 1/1989 Laudig et al. ..... 439/580
4,861,284 8/1989 Pauza et al. ..... 439/580
4,976,632 12/1990 Riches et al. ..... 439/580
5,062,808 11/1991 Hosler, Sr. ..... 439/580

*Primary Examiner*—Stephen P. Garbe
*Attorney, Agent, or Firm*—Leonard Bloom

[57] ABSTRACT

A connector compatible with balanced and unbalanced audio transmission lines includes a female connector having three coaxial cylindrical collets which match with the corresponding connection components of a two pole male connector, which has a central pin and a cylindrical external collet, perfectly identical in size and shape to those of a conventional unbalanced two pole male connector of the existing type PIN RCA. Being installed on a device, the female connector matches with either two pole PIN RCA male connector or the three pole male connector having the second collet.

10 Claims, 4 Drawing Sheets

CONNECTOR COMPATIBLE WITH AUDIO TRANSMISSION LINES, BALANCED AND UNBALANCED

BACKGROUND OF THE INVENTION

1. Field of the Invention

The present invention relates to a connector for transmission lines, and more particularly, to a connector that is compatible with audio transmission lines, balanced and unbalanced.

2. Description of the Prior Art

Two main systems are used today for audio signal transmission in musical equipment.

The simplest and cheapest system is that commonly known and referred to by experts in this field as an "unbalanced system". In this system the signal connections are realized with coaxial cables, which are usually composed of a central conductor surrounded by a screen; the first conductor is used for the signal transmission and is called "hot pole" while the screen is used as ground and called "cold pole".

On the end of such coaxial cables there are coaxial connectors, of the type commonly called "PIN RCA", mainly used in the Hi-Fi field, or of the type called "Jack".

The major inconvenience of these "unbalanced" systems consists in that they do not allow elimination of so called buzzing and noise. In fact, in the field of professional audio, such as musical instruments, or large musical equipment, the signal transmission is always done with a "balanced system", which is immune to the above-mentioned noise.

In the "balanced systems", also called "three ways", the connecting cables used are composed of three coaxial conductors, two "hot" ones (for signal transmission) and a third one for ground. It is clear that the terminal connectors of such cables must also have three poles, two "hot" ones and a third one for ground screen.

It must be said that, in current production, balanced connectors are much bigger than unbalanced ones. That is why they are not suited, apart from high costs, for use in broader consumption audio fields such as Hi-Fi where the devices tend to assume dimensions which are always more compact for purely aesthetical reasons.

SUMMARY OF THE INVENTION

It is, therefore, an object of the present invention to provide a connector of small size and low cost, which will be compatible with balanced and unbalanced transmission lines.

With this perspective, we designed a connector having shape and dimensions identical to those that already exist and are usually employed for unbalanced lines (conventionally called PIN RCA), but which is supplied with a third pole that permits use also with "balanced" lines.

In particular the female connector of this new design can receive the male connectors of new design as well as the male PIN RCA connectors presently used for "unbalanced" lines, while the male connector of new design cannot be inserted in the female PIN RCA connectors presently used for the "unbalanced" lines.

In consideration of the fact that female connectors are always installed on the device, while male connectors are installed on signal transmission cables, it is clear that the installation of the new female connectors on a instrument suited for a "balanced function" permits its function also in the "unbalanced" form. This means that this female can also receive the male of a common connector with two poles (PIN RCA).

On the other hand, a male connector according to the new design can never be inserted into a female connector with two poles, which is usually installed on devices capable of functioning only in an "unbalanced" way.

BRIEF DESCRIPTION OF THE DRAWINGS

For a clearer explanation the description proceeds with reference to the drawings which have only an illustrative and not restrictive purpose, in which.

DETAILED DESCRIPTION OF THE INVENTION

Figure 1:
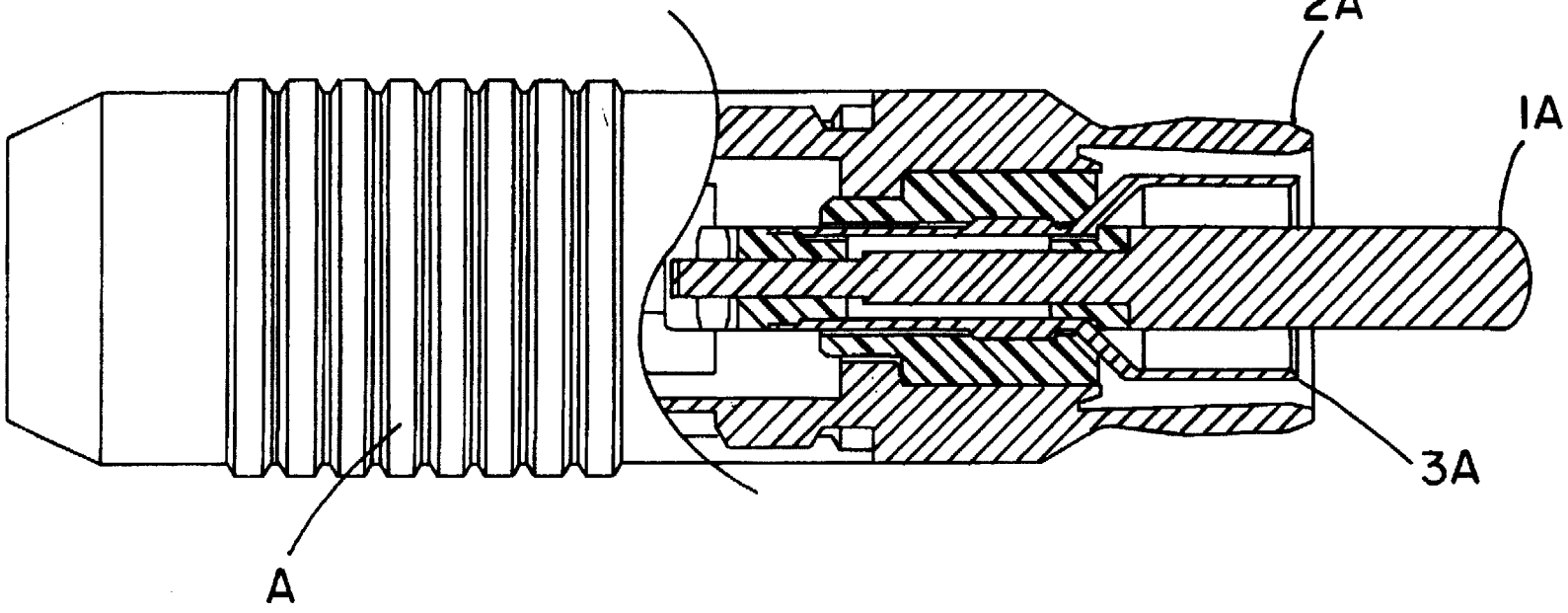
FIG. 1 shows the male connector of the present invention partially sectioned.

Referring to FIG. 1, the male connector (A) of the invention includes a first "hot" pole (1A), composed of a metallic pin extending centrally and co-axially within the cylindrical body of the male connector (A).

This "hot" pole (1A) is surrounded by a metallic cylindrical collet (2A) which works as a screen and is connected to "ground".

The reciprocal positioning, the dimensions and shape of the pole (1A) and of the collet (2A) perfectly correspond to those of a common "unbalanced" male connector (PIN RCA) of the existing type.

Outside of the "hot" pole (1A) and inside the collet there is a second metallic collet (3A), that constitutes the second "hot pole" of the three-way connector that has been invented. It will be appreciated by those skilled in the art that signal conduction cables must be connected to the hot poles (1A and 3A), while ground cable must be connected to the collet (2A).

Figure 2:
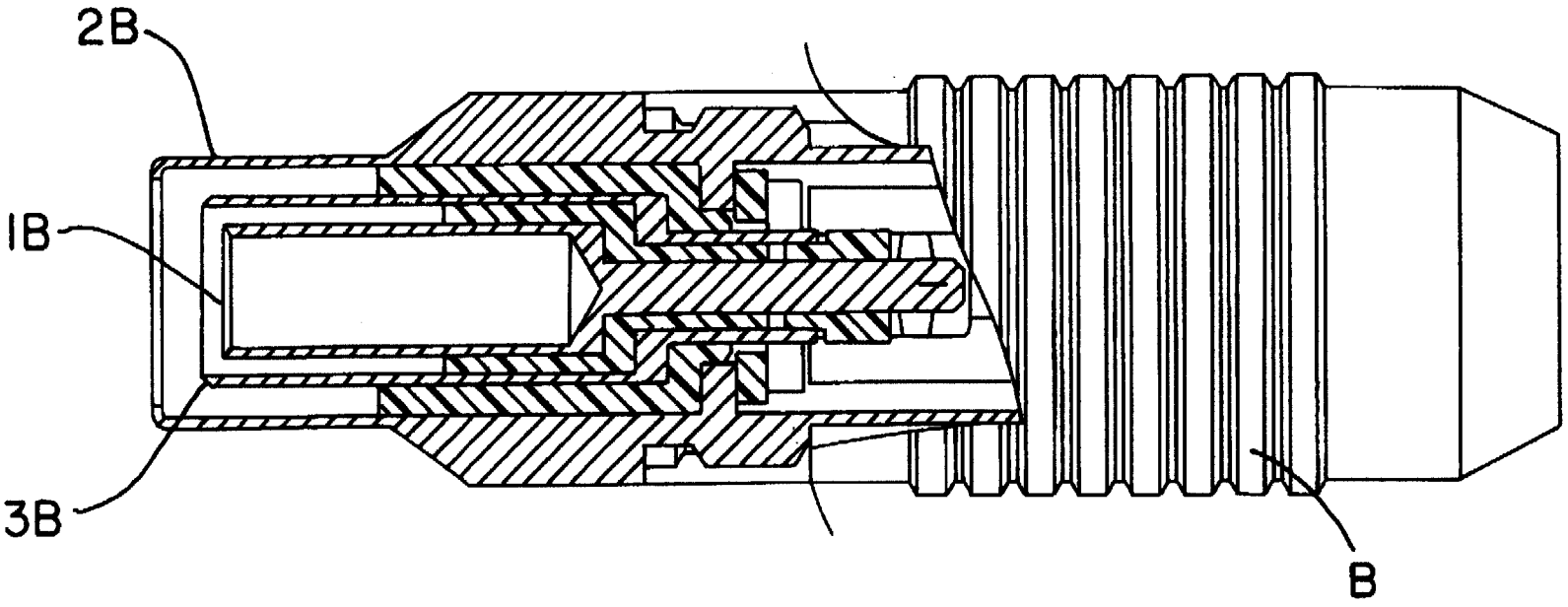
FIG. 2 shows the female connector of the present invention partially sectioned.

Referring to FIG. 2, the female connector (B) of the present invention has three-cylindrical and concentric collets, of which the internal one (1B) and the middle one (3B) constitutes the two "hot poles", while the external one (2B) is for ground.

The position, the dimensions and the shape of these three concentric collets (1B, 2B, and 3B) match perfectly with the corresponding elements (1A, 2A and 3A) of the male connector (A) best shown in FIG. 1.

Figure 3:
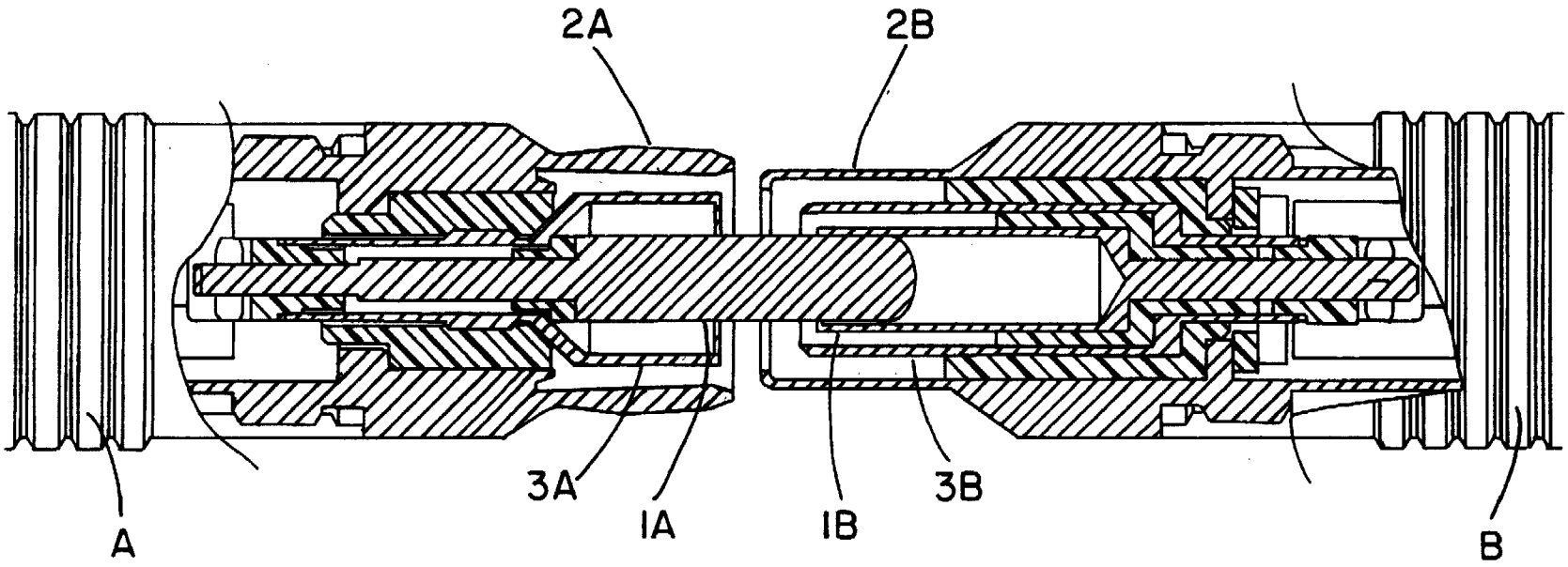
FIG. 3 shows the male-connector and the female-connector of the invention coupled together.

In particular, the collets (2B and 3B) of the female connector (B) fit perfectly into the corresponding collets (2A and 3A) of the male connector while the pin (1A) of the male connector (A) slips perfectly into the internal collet (1B) of the female connector (B), as shown in FIG. 3.

Figure 4:
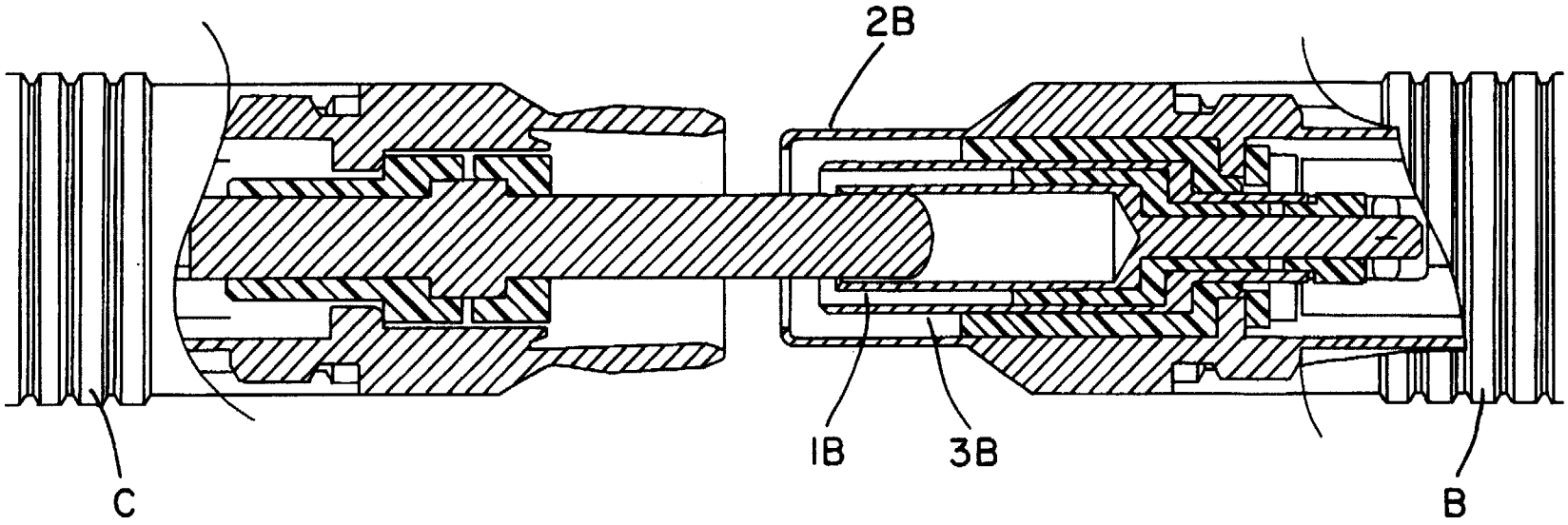
FIG. 4 shows the female-connector of the present invention, coupled with an unbalanced male-connector of the existing type (PIN RCA).

As shown in FIG. 4, a standard male connector (C) of the "unbalanced" type (PIN RCA) can be inserted into the female-connector (B) of the present invention, even though, of course, in this case the collet (3B) does not match with any corresponding element.

In other words, the signal transmission, in this case, will be "unbalanced" even if the device on which the female connector is installed is set up for "balanced" function.

I claim:

1. A connector compatible with balanced and unbalanced transmission lines, comprising: a female connector and a male connector matable to each other, wherein the female connector includes internal, intermediate and external co-axial cylindrical collets;

wherein the male connector is compatible with a standard PIN RCA connector and includes a central pin and an external cylindrical collet surrounding the central pin and co-axial therewith; and wherein, once the male connector engages the female connector, then the central pin of the male connector fits into the internal cylindrical collet of the female connector and the external cylindrical collet of the male connector engages externally the external cylindrical collet of the female connector, thereby providing a mechanical and electrical connection therebetween.

2. The connector of claim 1, wherein said male connector further includes an intermediate cylindrical collet positioned co-axially between the central pin and the external cylindrical collet of the male connector;

wherein, once the male connector engages the female connector, then the intermediate cylindrical collet of the male connector engages externally, the intermediate cylindrical collet of the female connector, thereby providing a further mechanical and electrical connection between the male and female connectors.

3. The connector of claim 1, wherein the male connector is an unbalanced male connector.

4. The connector of claim 2, wherein the male connector is a balanced male connector.

5. The connector of claim 1, being compatible with the unbalanced transmission lines.

6. The connector of claim 2, being compatible with the balanced transmission lines.

7. The connector of claim 1, wherein the central pin of the male connector and the internal cylindrical collet of the female connector constitute a "hot" pole of the connector; and wherein the external cylindrical collets of the male connector and the female connector, respectively, constitute the ground of the connector.

8. The connector of claim 2, wherein the central pin of the male connector and the internal cylindrical collet of the female connector constitute a first "hot" pole of the connector;

wherein the intermediate cylindrical collets of the male connector and the female connector constitute a second "hot" pole; and wherein the external cylindrical collets of the male connector and the female connector, respectively, constitute the ground of the connector.

9. A connector compatible with balanced and unbalanced transmission lines, comprising:

a female connector and a male connector, wherein the female connector includes internal, intermediate and external co-axial cylindrical collets;

wherein the male connector is selected from a group of a first male connector and a second male connector, the first and the second male connectors being matable with said female connector;

wherein the first male connector is a standard PIN RCA connector and includes a central pin surrounded by an external cylindrical collet;

wherein the second male connector includes a central pin surrounded by an external cylindrical collet, and further includes an intermediate cylindrical collet positioned co-axially between the central pin and the external cylindrical collet of the second male connector;

wherein the connector is compatible with unbalanced transmission lines when the female connector is coupled with the first male connector; and wherein the connector is compatible with the balanced transmission lines when the female connector is coupled with the second male connector.

10. The connector of claim 9, wherein the central pin of either one of the first and second male connector snugly fits into the cylindrical internal collet of the female connector;

wherein the external cylindrical collet of either one of the first and second male connectors engages externally the external cylindrical collet of female connector; and wherein the intermediate cylindrical collet of the second male connector engages externally the intermediate cylindrical collet of the female connector; thereby providing electrical and mechanical connection therebetween.

* * * * *